US005782732A

United States Patent [19]

Herrin

[11] Patent Number: 5,782,732

[45] Date of Patent: Jul. 21, 1998

[54] TRAY FORMING APPARATUS AND METHOD OF FORMING SAME

[76] Inventor: Robert M. Herrin, 5935 Groveline Dr., Orlando, Fla. 32810

[21] Appl. No.: 758,095

[22] Filed: Nov. 29, 1996

[51] Int. Cl.[6] ..... B31B 1/36; B31B 3/60

[52] U.S. Cl. ..... 493/131; 493/142; 493/177; 493/178; 493/182

[58] Field of Search ..... 493/124, 125, 493/130, 131, 141, 142, 144, 177, 178, 179, 180, 182, 52

[56] References Cited

U.S. PATENT DOCUMENTS

| | | | |
|---|---|---|---|
| 4,460,349 | 7/1984 | Charron | 493/177 |
| 4,500,306 | 2/1985 | Nowacki | 493/130 |
| 4,578,054 | 3/1986 | Herrin | 493/144 |

FOREIGN PATENT DOCUMENTS

| | | | |
|---|---|---|---|
| 2037697 | 7/1980 | United Kingdom | 493/131 |

*Primary Examiner*—Jack W. Lavinder
*Attorney, Agent, or Firm*—Allen, Dyer, Doppelt, Milbrath & Gilchrist

[57] ABSTRACT

A tray forming apparatus and method are provided which advantageously increase the efficiency and production speed of tray-type containers formed thereby. The apparatus preferably includes a loader for loading one of a plurality of blanks to be transported along a predetermined path of travel and front and rear panel lifters positioned downstream from the loader for foldingly lifting front and rear panels of the one blank upwardly and inwardly during travel along the predetermined path. Adhesive applicators preferably are positioned adjacent the folders for applying adhesive only to selected portions of the folded front and rear panels of the one blank. Side panel folders are positioned downstream from the front and rear panel folders and the adhesive applicators for folding side panels of the one blank upwardly and inwardly into abutting contact with the selected portions of the folded front and rear panels having adhesive applied thereto.

40 Claims, 11 Drawing Sheets

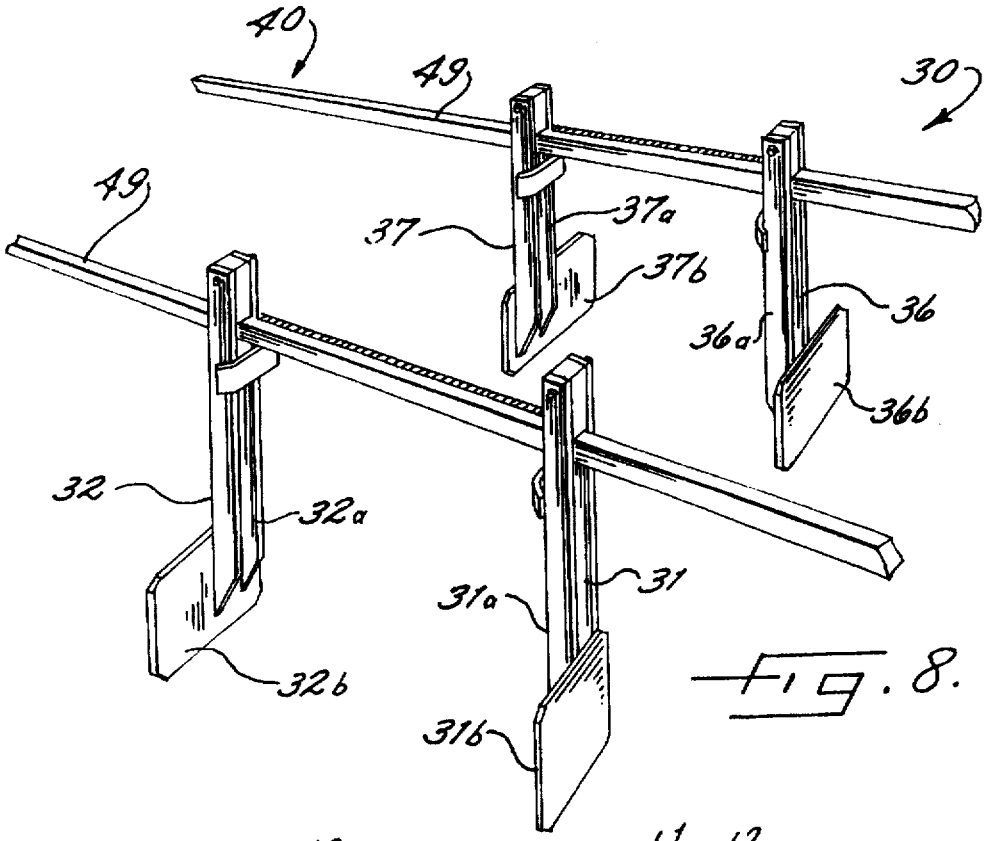
Fig. 8.
Fig. 9.
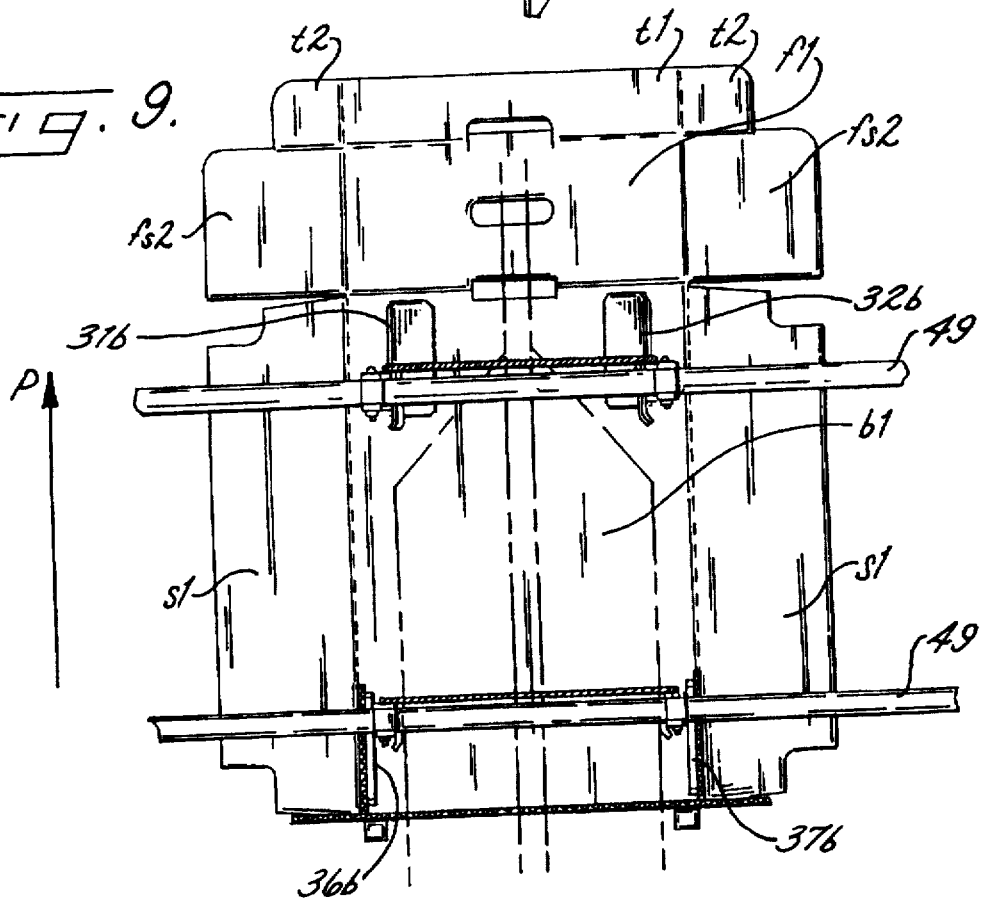

TRAY FORMING APPARATUS AND METHOD OF FORMING SAME

FIELD OF THE INVENTION

This application is related to containers and container systems and, more particular, to a container forming apparatus and associated methods.

BACKGROUND OF THE INVENTION

In the produce industry, for example, various packaging elements or containers, such as cartons, boxes, or trays formed of cardboard, wood, or polymeric materials, are often used to pack, store, ship and/or display produce throughout the world. Packers or packing plants are often responsible for harvesting or gathering the produce, sorting and grading the produce, preparing the produce such as by washing and waxing, and packing the produce into containers for shipment. Because of the various industry demands on the packing plants such as needs for more timely deliveries, for lower or more control of labor costs, for more inventory control and lower inventory costs, for more control over the sorting and grading, preparing, packing, shipping, storing, and displaying processes, problems have arisen at various stages of these processes.

One of the areas where problems have arisen is in the supply speed and control of the tray-type containers used for packing, shipping, storing, and displaying the produce. Conventionally, for example, tray-type containers may be formed of a cardboard material which is relatively inexpensive, relatively lightweight, and in many cases can be recycled. These tray-type containers preferably are shaped and sized for particular purposes. These purposes include storing, carrying, shipping, and displaying the produce once it is packed. The forming of these tray-type of containers, however, can be time consuming particularly where the needs in the industry are for increased tray-type container production speed without damage to the tray-type containers being produced. These tray forming machines can also be large, occupy a lot of square footage of a production or packing floor, complex and increased mechanical reliability problems.

Additionally, containers often have labels printed or affixed to outer surfaces of the containers for identifying and advertising the farms, cooperatives, packers, and/or wholesale distributors responsible for the produce. What often occurs is that a wholesale distributor desires its label or name to be on a container during the shipping, displaying, and selling processes to identify and advertise its image to retailers and the consuming public. The wholesale distributor then requests that the packers or packing plants use tray-type containers having its label or name already affixed thereto. Packing houses then must use and track different labelled containers for different customers and coordinate the correctly labeled containers to keep a smooth and efficient operation in the packing plant. Because the tray-type container will often need to have an appropriate label affixed thereto or will often need to be formed of a blank having the label fixed thereto, this tray-type container label coordination problem further exacerbates the container production problem as well, particularly where enhanced production speed is often needed.

OBJECTS AND SUMMARY OF THE INVENTION

With the foregoing in mind, it is an object of the present invention to provide a tray forming apparatus and associated method for forming trays or tray-type containers at a higher production speed.

It is also an object of the present invention to provide a more efficient tray forming apparatus and associated method for forming trays or tray-type containers.

It is an additional object of the present invention to provide a tray forming apparatus and associated method that requires fewer adhesive applicator locations on a blank from which the tray is formed uses less adhesive material to accomplish a similarly erected tray, and is more reliable.

It is a further object of the present invention to provide a stackable tray forming apparatus that requires a smaller area for high speed forming of a plurality of stackable trays.

A tray forming apparatus according to the present invention preferably has front and rear panel lifting means positioned for foldingly lifting front and rear panels of a blank upwardly and inwardly and adhesive applying means positioned adjacent the front and rear panel lifting means for applying adhesive only to portions of the folded front and rear panels of a blank. Side panel folding means are positioned downstream from the front and rear panel lifting means and the adhesive applying means for folding side panels of a blank upwardly and inwardly into abutting contact with the selected portions of the folded front and rear panels having adhesive applied thereto.

More particularly, a tray forming apparatus according to the present invention is provided for forming a tray from a blank having a plurality of cut and fold lines. The blank, for example, preferably is pre-cut and preferably has a bottom panel, a pair of major side panels connected to the bottom panel along a common fold line, and front and rear panels each connected to the bottom panel along respective common fold lines. A pair of front minor side panels are each respectively connected along common fold lines to the front panel, and a pair of rear minor side panels are each respectively connected along common fold lines to the rear panel. A pair of top major panels are each respectively connected to the front and rear panels along a common fold line, and a pair of top minor panels are connected to each of the top major panels along common fold lines.

The apparatus preferably hasloading means for loading the blank to be transported along a generally horizontal plane in a predetermined direction of travel and fold guiding means positioned to overlie the one blank along the direction of travel for guiding the folding of the panels of the blank. The fold guiding means includes at least a pair of front guide arms and a pair of rear guide arms. A pair of spaced-apart rail guides are positioned downstream from the loading means for respectively guiding each of the forward minor side panels of the blank upwardly and inwardly to a position closely adjacent one of the pair of front guide arms and for respectively guiding each of the rearward minor side panels of the one blank upwardly and inwardly to a position closely adjacent one of the pair of rear guide arms when the one blank travels downstream between the pair of spaced-apart rail guides. A pair of spaced-apart adhesive applicators are positioned downstream from the pair of spaced-apart rail guides for applying adhesive to the outer surface of each of the forward minor side panels and the rearward minor side panels during downstream travel thereof as the blank travels downstream between each of the spaced-apart adhesive applicators.

Front and rear panel lifting means are positioned downstream from the pair of spaced apart rail guides for lifting each of the front and rear panels of the one blank upwardly and inwardly. Top panel guiding means are positioned downstream from the front panel lifting means for guiding each of the major top panels of the one blank downwardly and inwardly so that the inner surface of each of the major top panels overlies the inner surface of the bottom panel of the blank and for guiding each of the minor top panels downwardly and inwardly so that the inner surface of the minor top panel abuttingly contacts the outer surface of the minor side panel and the adhesive applied thereto.

The apparatus further preferably has major side panel rail guides positioned downstream from the front panel lifting means for foldingly guiding the major side panels upwardly and inwardly so that the inner surface of each end periphery portion of each major side panel abuttingly contacts the outer surface of each respective forward and rear minor side panel. Compressing means are positioned downstream from the major side panel rail guides for compressing the outer surfaces of the top minor panels and the end periphery portions of the major side panels so that the inner surfaces of the top minor panels and the end periphery portions of the major side panels press against the outer surface of the minor side panels of the blank to thereby adhesively secure the blank in an erect position. Discharging means are positioned downstream from the compressing means for discharging erect trays therefrom.

The present invention also includes methods of forming a tray-type container from a pre-cut blank. The method preferably includes lifting front and rear panels of a blank upwardly and inwardly during travel along a predetermined path of travel in a generally horizontal plane and applying adhesive to portions of folded front and rear panels of the blank when the blank travels between at least a pair of space-apart adhesive applicators. Side panels of the blank are also folded upwardly and inwardly into abutting contact with the selected portions of the folded front and rear panels having adhesive applied thereto.

A tray forming apparatus and method according to the present invention thereby advantageously provides a streamlined and efficient process for producing tray-type containers from pre-cut blanks. The apparatus advantageously uses fewer surfaces of a blank for applying adhesive thereto and yet produces the same container more efficiently, at a higher speed, and with similar structural bonding strength. The apparatus advantageously can require less footprint in a production line and be readily substitute various labeled blanks for producing labelled trays for various customers at higher speeds.

BRIEF DESCRIPTION OF THE DRAWINGS

Some of the objects, features, advantages, and uses of the present invention having been stated, others will become more apparent by referring to the following detailed description and drawings in which:

FIG. 8 is a perspective view of two pairs of folding guide arms of a tray forming apparatus according to the present invention;

FIG. 9 is a top plan view of two pairs of folding guide arms being positioned to overlie a blank for forming a tray therefrom by use of a tray forming apparatus according to the present invention;

DETAILED DESCRIPTION

The present invention will now be described more fully hereinafter with reference to the accompanying drawings in which preferred embodiments of the invention are shown. This invention, however, may be embodied in many different forms and should not be construed as limited to the illustrated embodiments set forth herein. Rather, applicant provides these embodiments so that this disclosure will be thorough and complete, and will fully convey the scope of the invention to those skilled in the art. Like numbers refer to like elements throughout.

Figure 1:
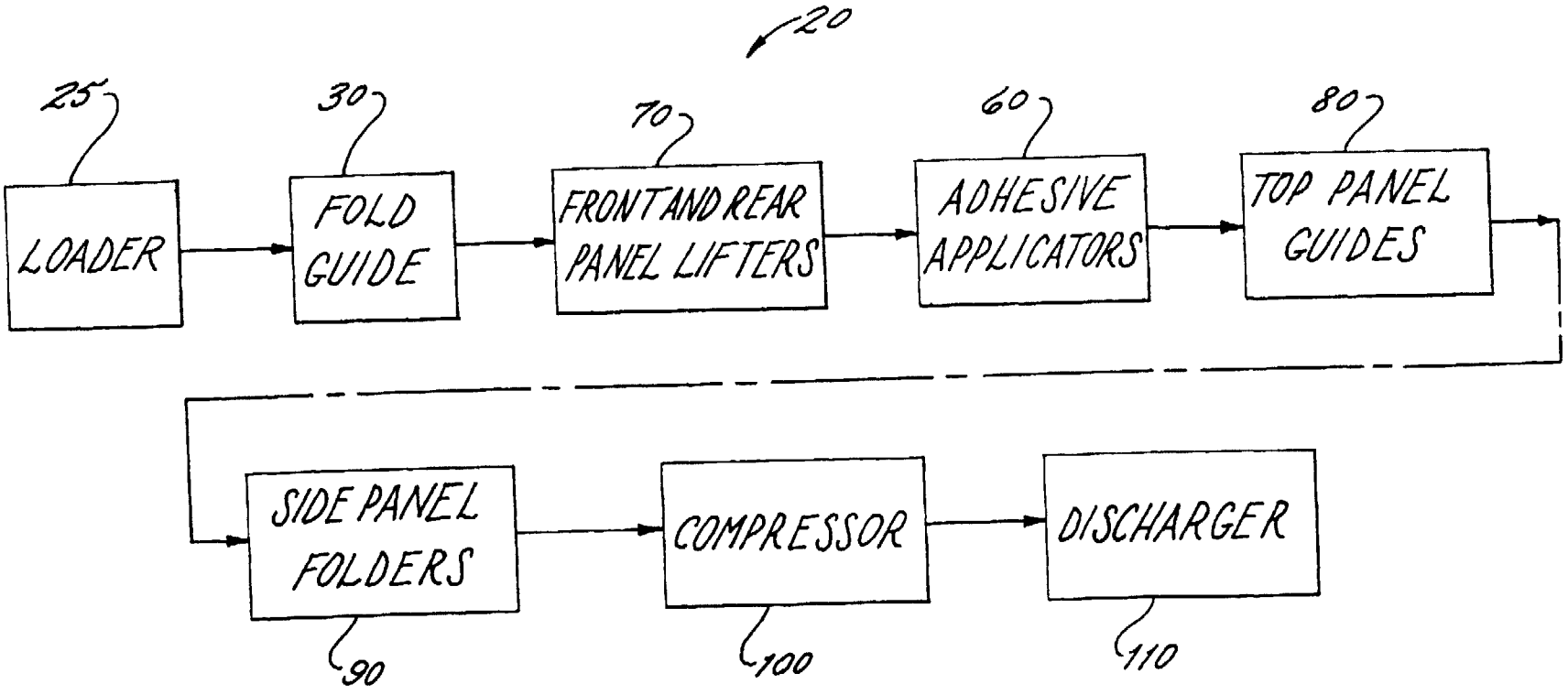
FIG. 1 is a schematic block diagram of a tray forming apparatus and method according to the present invention.
Figure 2:
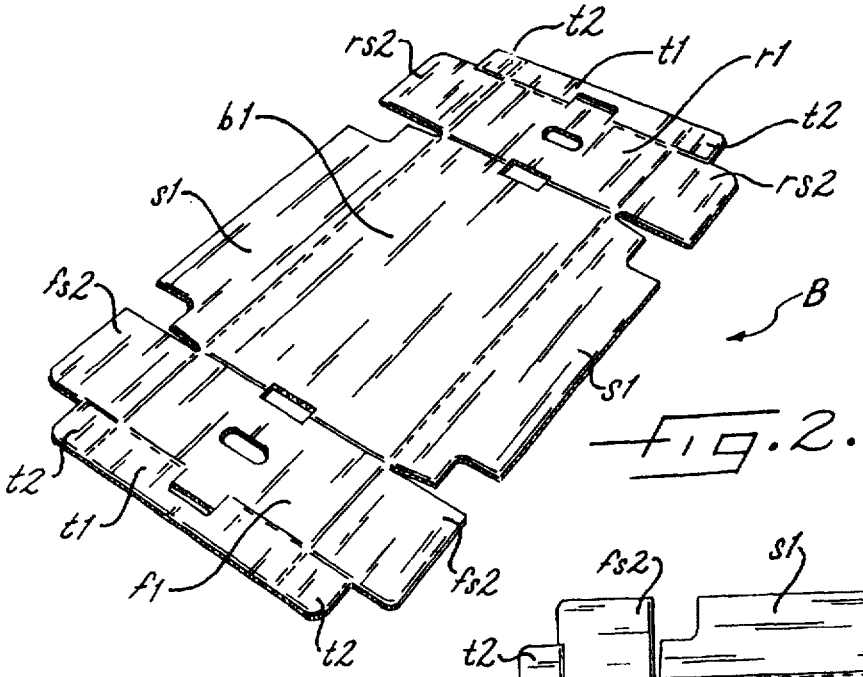
FIG. 2 is a top perspective view of a blank for forming a tray by use of a tray forming apparatus according to the present invention.
Figure 3:
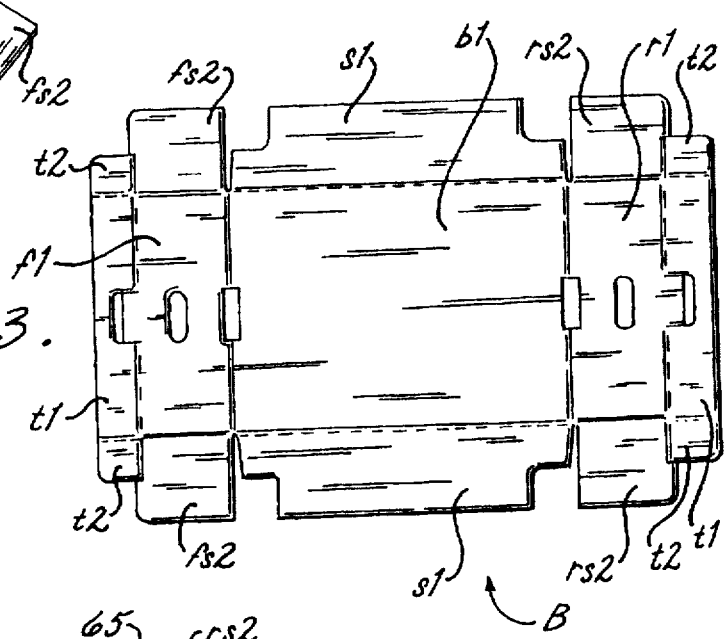
FIG. 3 is a top plan view of a blank for forming a tray by use of a tray forming apparatus according to the present invention.
Figure 4:
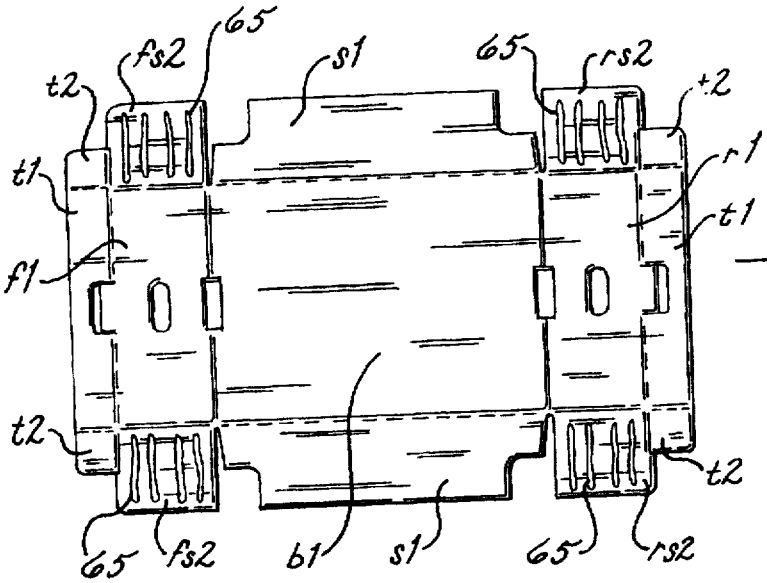
FIG. 4 is a bottom plan view of a blank having adhesive lines illustrated thereon for forming a tray by use of a tray forming apparatus according to the present invention.
Figure 5:
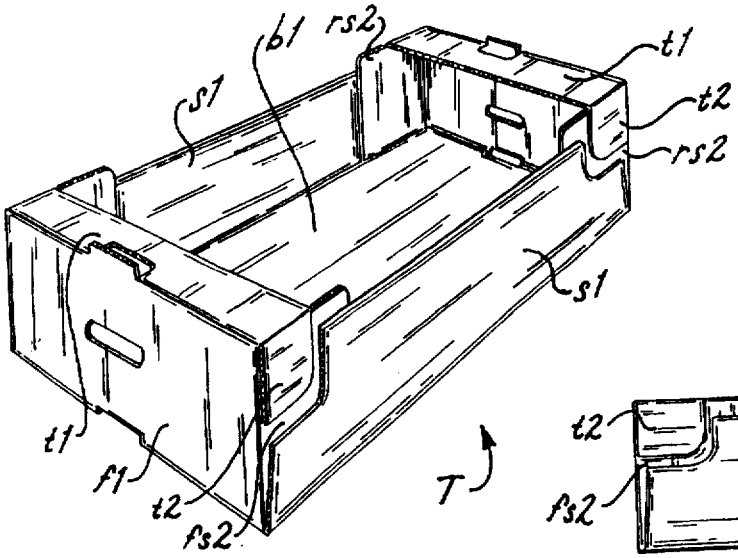
FIG. 5 is a perspective view of a tray formed by use of a tray forming apparatus according to the present invention.
Figure 6:
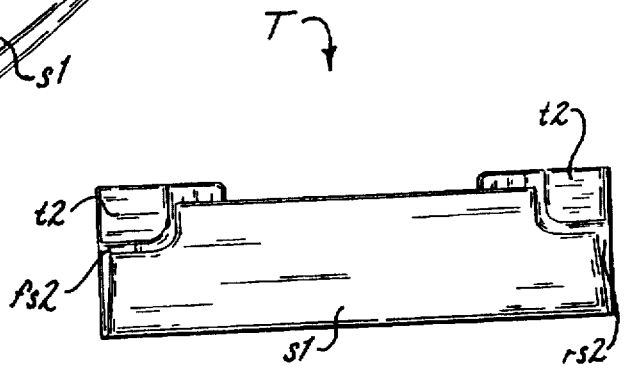
FIG. 6 is a side elevational view of a tray formed by use of a tray forming apparatus according to the present invention.
Figure 7:
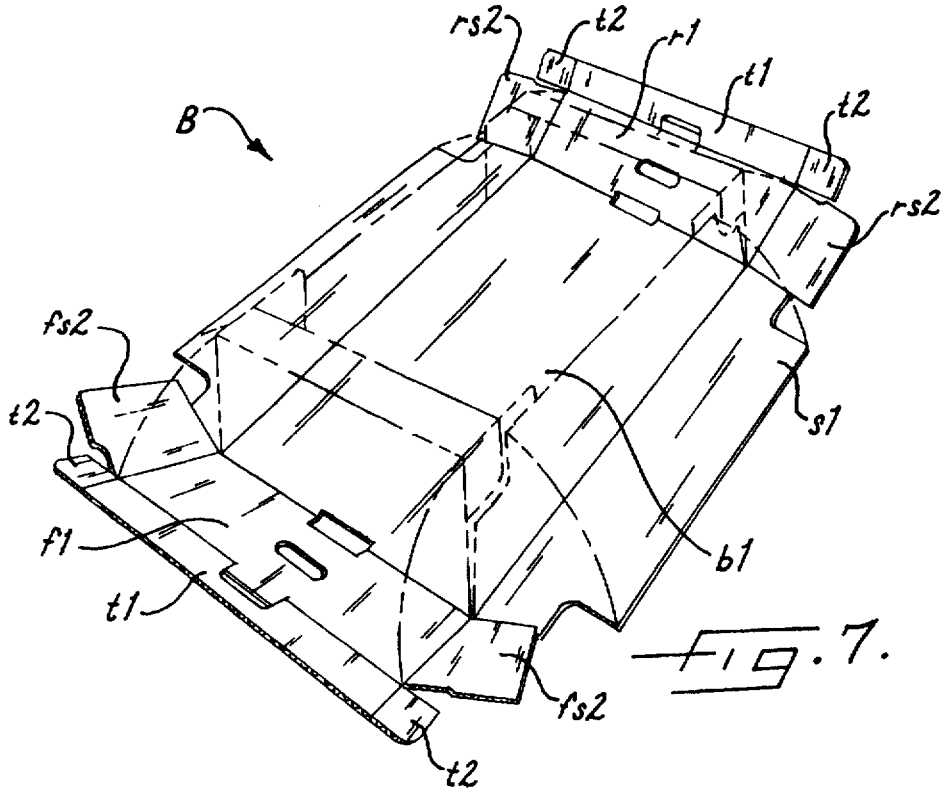
FIG. 7 is a perspective view which shows folding of a blank to form a tray in phantom lines by use of a tray forming apparatus according to the present invention.
Figure 10:
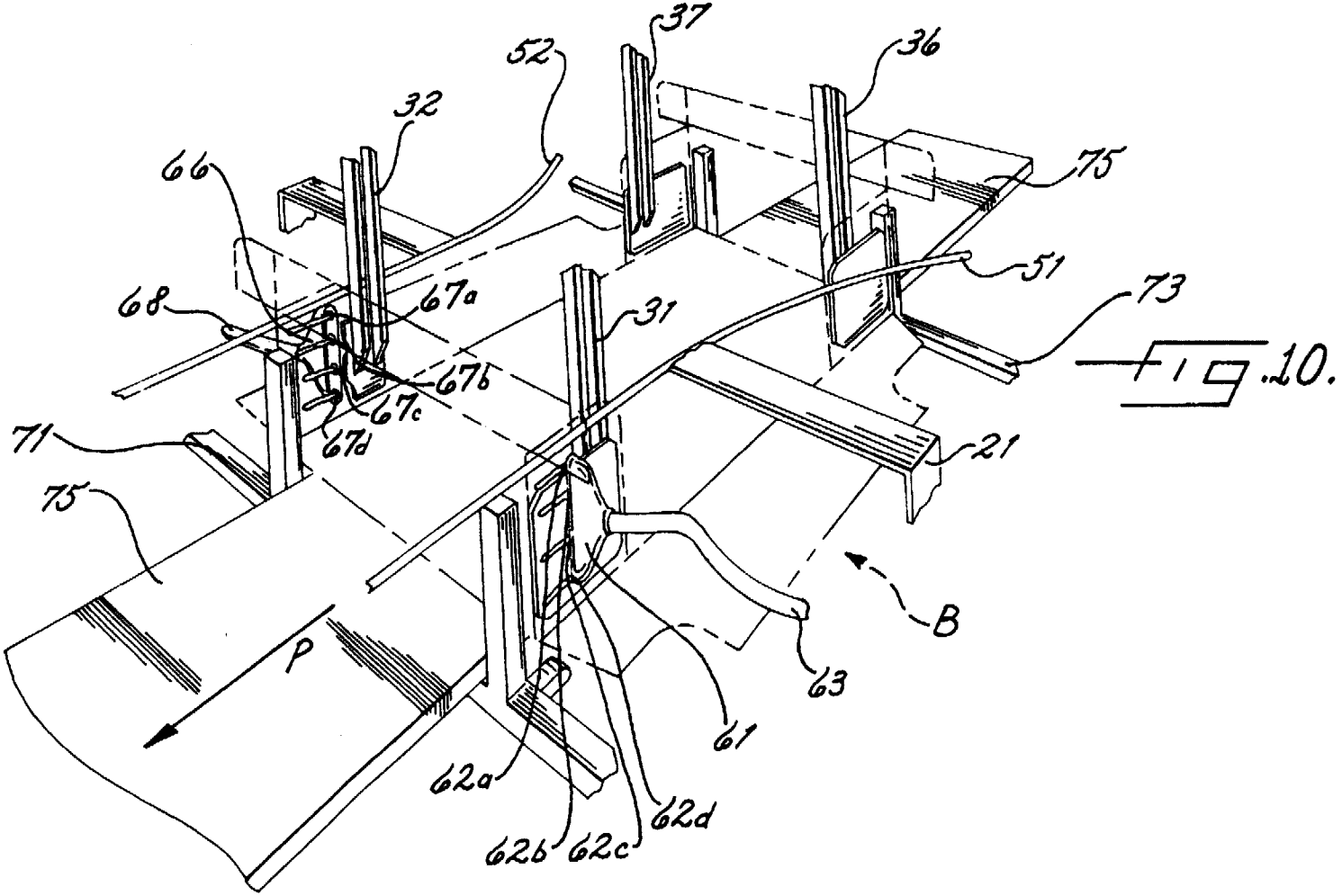
FIG. 10 is a perspective view of a tray forming apparatus according to the present invention.
Figure 11A:
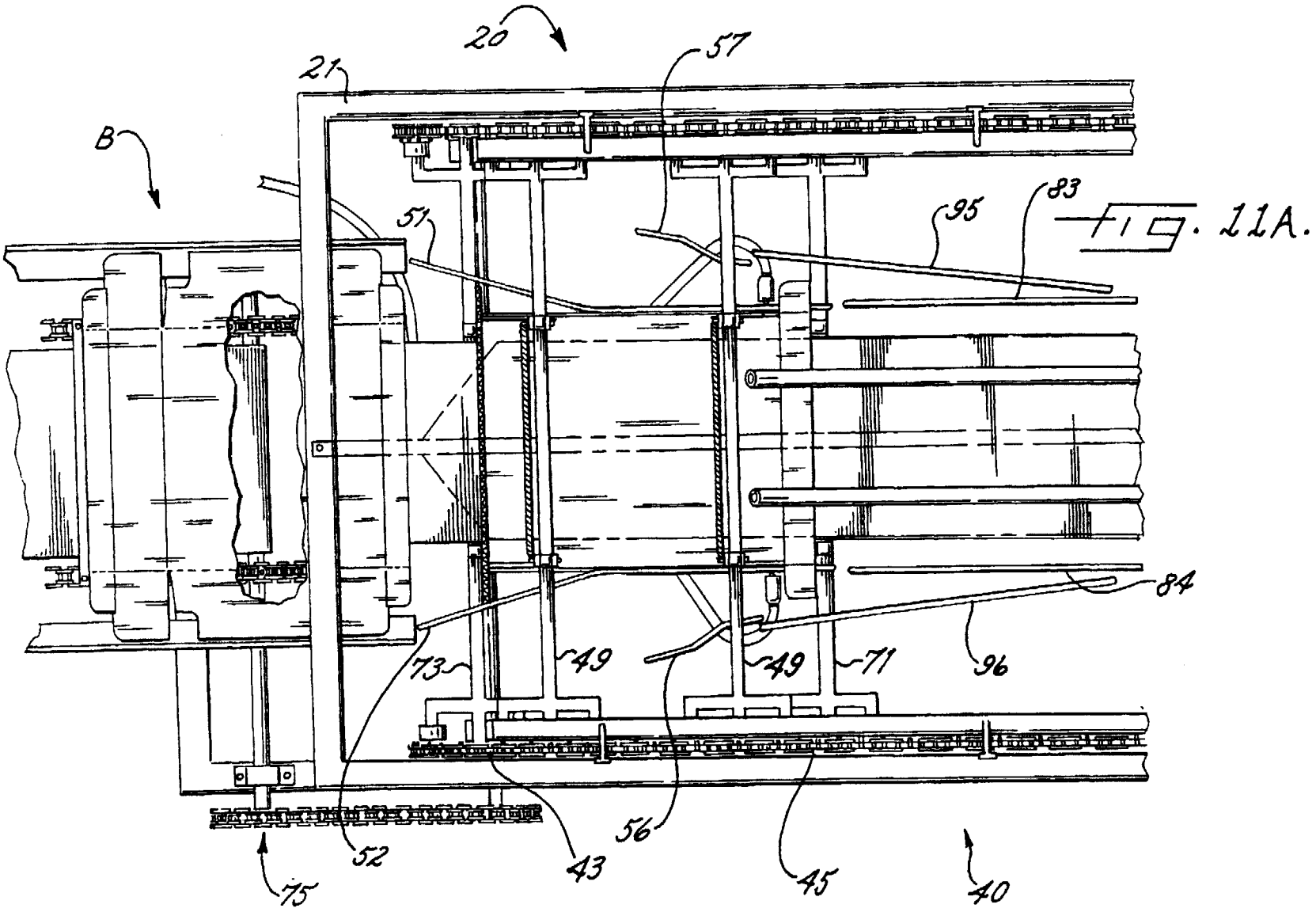
FIGS. 11A–11B are top plan views of a tray forming apparatus according to the present invention.
Figure 11B:
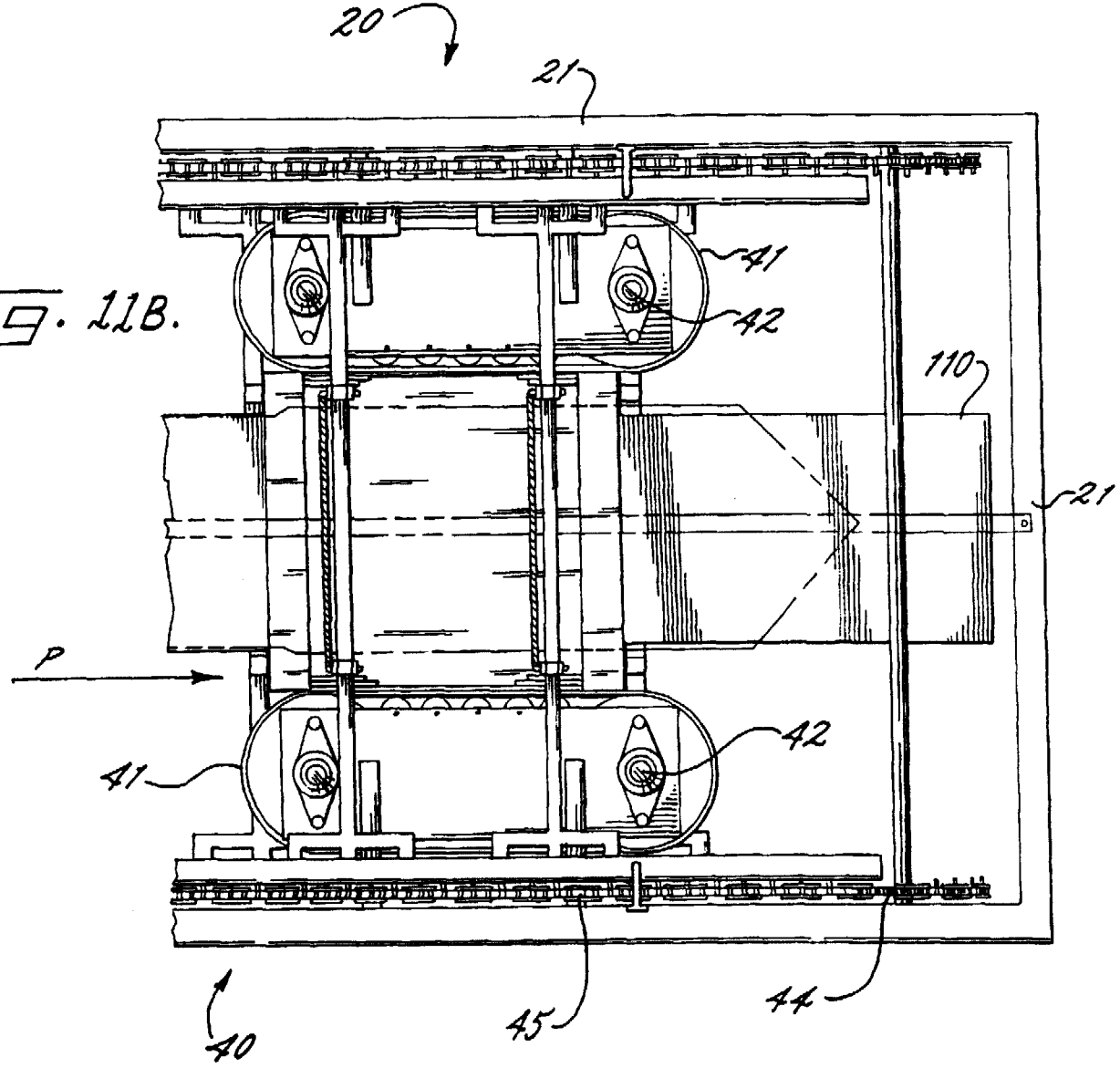
Figure 12A:
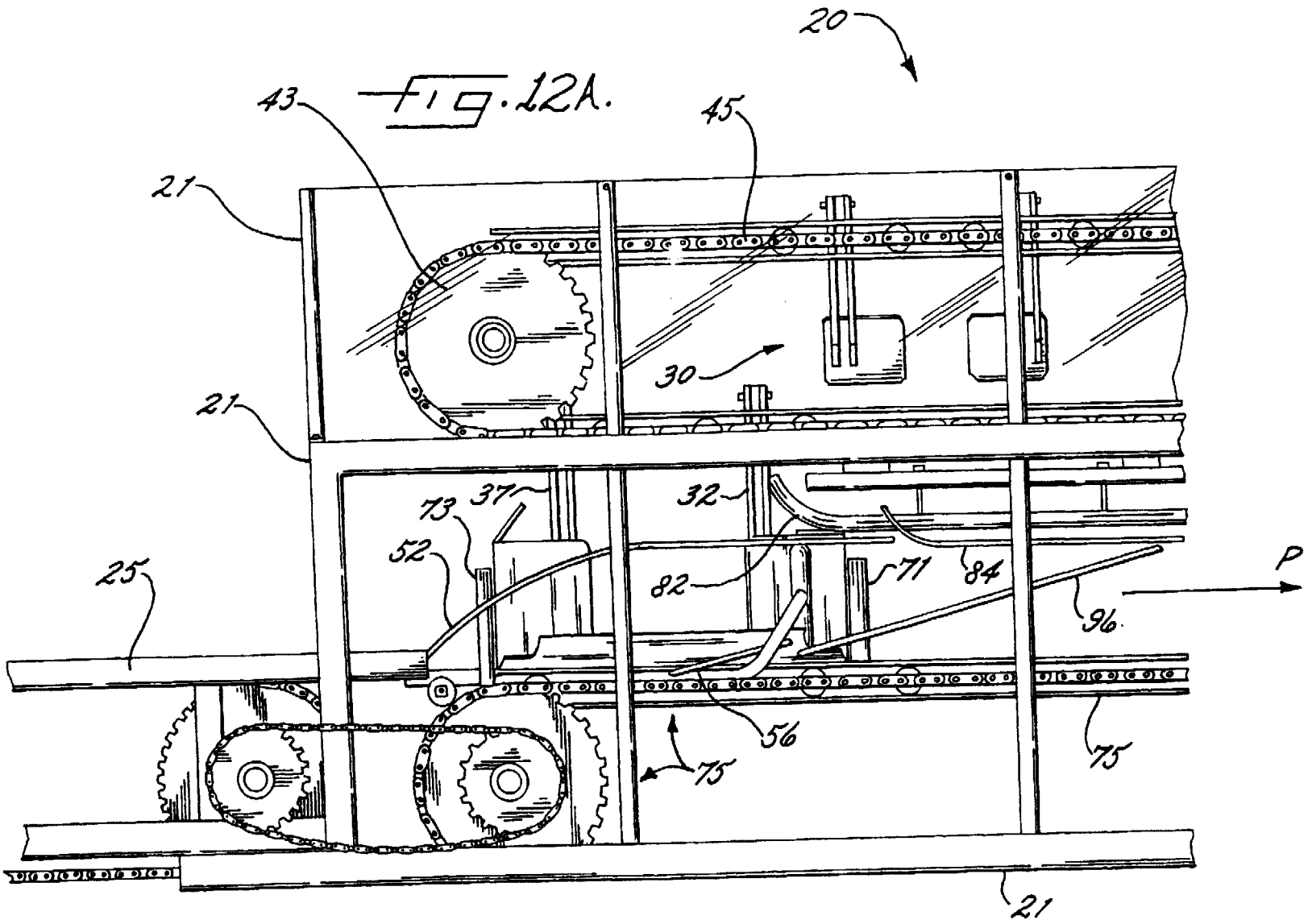
FIGS. 12A–12B are side elevational views of a tray forming apparatus according to the present invention.
Figure 12B:
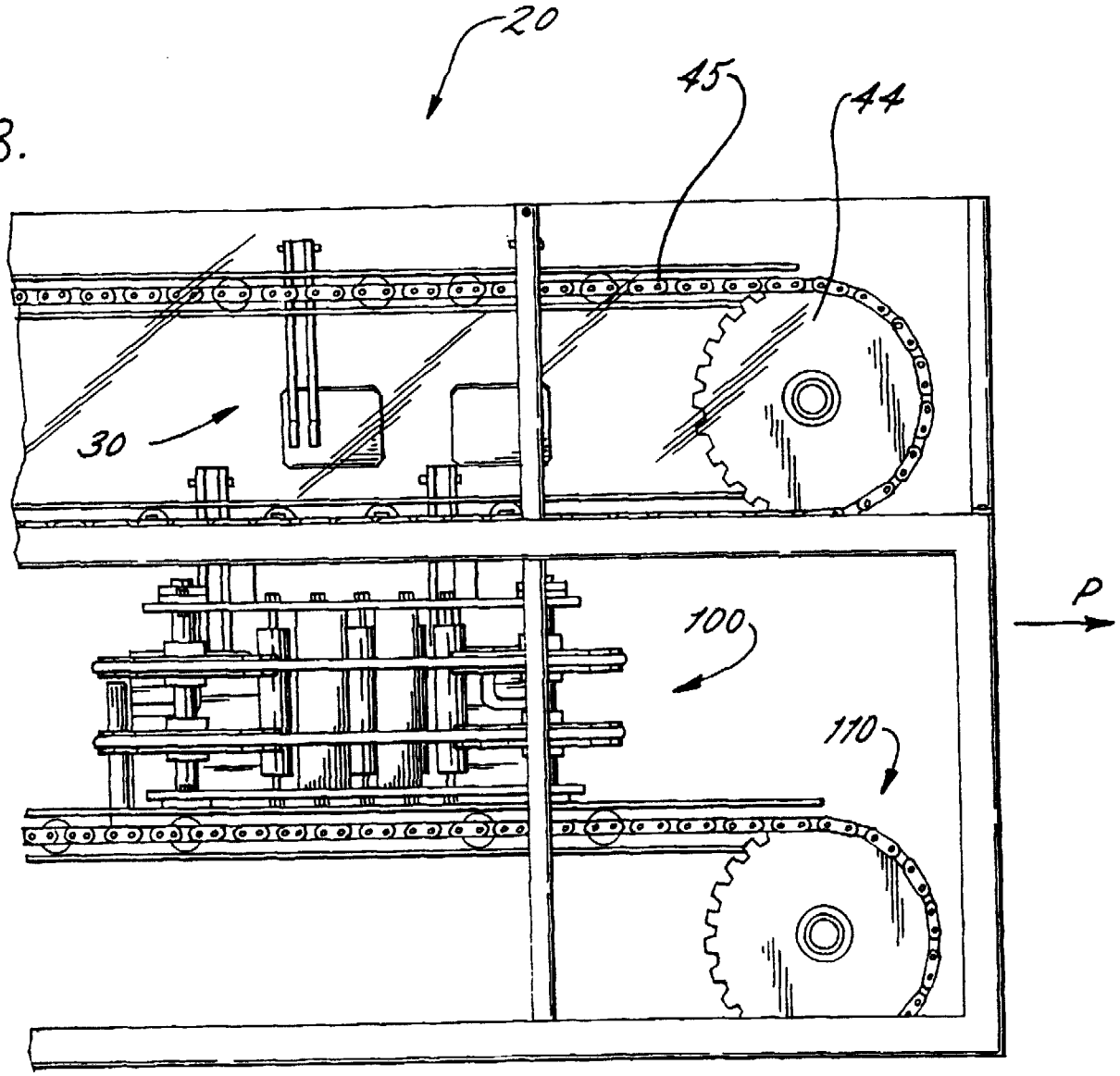
Figure 13:
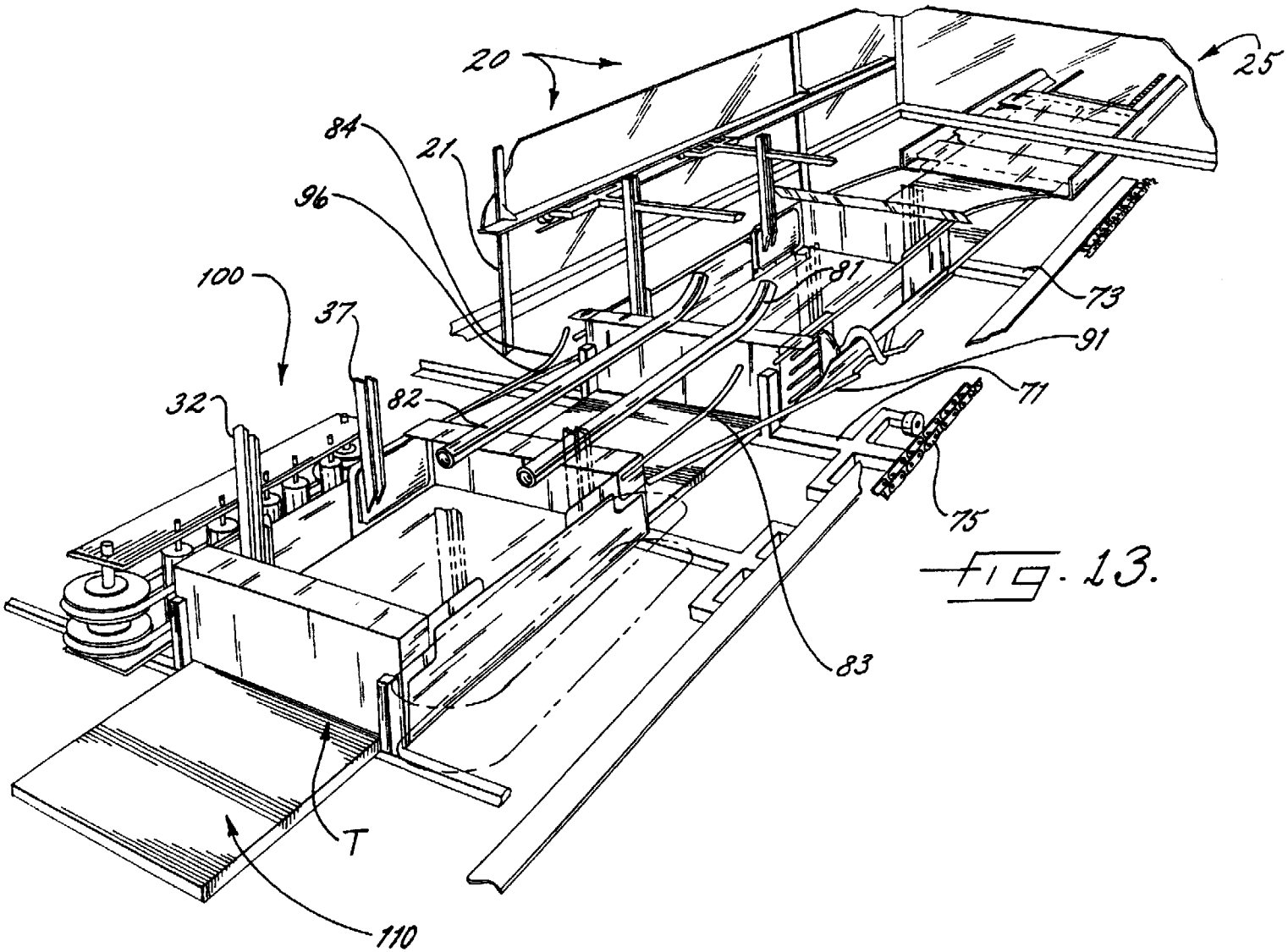
FIG. 13 is a perspective view of a tray forming apparatus according to the present invention.

FIG. 1 schematically illustrates an overview of a tray forming apparatus 20 according to the present invention. FIGS. 2–7 illustrate a preferred pre-cut blank B from which the tray forming apparatus 20 forms a tray-type container T therefrom. The pre-cut blank B for use with an apparatus 20 according to the present invention preferably has a plurality of cut and fold lines. As illustrated, the blank B has a bottom panel b1, a pair of major side panels s1 connected to the bottom panel along a common fold line, and front f1 and rear r1 panels each connected to the bottom panel along respective common fold lines. A pair of front minor side panels fs2 are each respectively connected along common fold lines to the front panel f1, and a pair of rear minor side panels rs2 are each respectively connected along common fold lines to the rear panel r1. A pair of top major panels t1 are each respectively connected to the front and rear panels along a common fold line, and a pair of top minor panels t2 are connected to each of the top major panels t1 along common fold lines.

As best illustrated in FIGS. 1 and 8–13, an apparatus 20 according to the present invention preferably has a frame 21, including a plurality of vertical and horizontal frame members, and loading means 25, e.g., a loader, connected to the frame 21 for loading the blank B to be transported along a generally horizontal plane in a predetermined path or direction of travel P. The loader 25 preferably receives a plurality of blanks B in a stack and loads or delivers one blank B at a time downstream for the tray forming operation by a conveyor such as illustrated in FIGS. 10, 11A, 12A, and 13. As will be readily understood by those skilled in the art, the blank is conveyed from the bottom of the stack underneath a bar of the frame laterally extending across the generally horizontal path of travel of the blank (see FIGS. 11A and 13).

Fold guiding means 30, e.g., a fold guide, are also connected to the frame and are positioned to overlie the blank B along the direction of travel P for guiding the folding of the various panels of the blank B. The fold guide 30 is preferably configured for travelling downstream in conjunction with the blanks B and is preferably positioned to overlie the inner confines of the blanks B so that when panels of the blanks B are folded inward the fold guide acts as a stop to the inner surface of the panel to ensure that the panel being folded is not folded inwardly too far. The fold guide 30 preferably is limited to those panels which have adhesive applied thereto advantageously for reinforcement as described further herein. As understood by those skilled in the art, however, the fold guide 30 can also encompass other panels as well.

The fold guiding means 30 preferably include at least a pair of front guide arms 31, 32 and a pair of rear guide arms 36, 37 and preferably include a plurality of sets of pairs of front guide arms 31, 32 and pairs of rear guide arms 36, 37. Each of the guide arms 31, 32, 36, 37 preferably are connected to a horizontally oriented mounting member 49 (see FIG. 8). Guide arm conveying means 40 preferably are connected to each pair of front guide arms 31, 32 and each pair of rear guide arms 36, 37 for conveying each of the plurality of sets of pairs of front guide arms 31, 32 and pairs of rear guide arms 36, 37 downstream. Each of the front and rear guide arms 31, 32, 36, 37 respectively includes an arm member 31*a*, 32*a*, 36*a*, 37*a* and a plate member 31*b*, 32*b*, 36*b*, 37*b*, connected to an end of the arm member 31*b*, 32*b*, 36*b*, 37*b*. The outer surface of the plate member preferably is adapted to abuttingly contact the inner surface of a minor side panel f2, rs2. The guide arm conveying means 40 preferably has a drive, e.g., motor(s) 41 and shaft(s) 42 and/or cam drives 41, 42, a first sprocket 43 connected to the drive 41, 42, a second sprocket 44 positioned spaced-apart from the first sprocket, and a chain 45 extending between and mounted to the first and second sprockets 43, 44. Preferably, the drive 41, 42 drives the first sprocket 43 and the chain 45 and second sprocket 44 mounted thereto and the plurality of sets of pairs of front and rear guide arms 31, 32, 36, 37 travel along a circular path of travel as illustrated.

The apparatus 20 also has a pair of spaced-apart rail guides 51, 52 positioned downstream from the loading means for respectively guiding each of the forward minor side panels fs1 of the blank B upwardly and inwardly to a position closely adjacent one of the pair of front guide arms 31, 32 and for respectively guiding each of the rearward minor side panels rs2 of the blank B upwardly and inwardly to a position closely adjacent one of the pair of rear guide arms 36,37 when the blank B travels downstream between the pair of spaced-apart rail guides 51, 52 the forward and rear minor side panels, fs1, rs2, for example, having portions thereof which contact the spaced-apart guide rails 51, 52 after the blank is conveyed from the loader 75 so that the rails contact the forward and rear minor side panels fs1, rs2. The major side panels, however, continue to lay flat and pass underneath the guide rails 51, 52 as illustrated in FIGS. 7, 11A, 12A, and 13 and as understood by those skilled in the art. A pair of spaced-apart adhesive applicators 61, 66 are positioned downstream from the pair of spaced-apart rail guides 51, 52 for applying adhesive to the outer surface of each of the forward minor side panels fs2 and the rearward minor side panels during downstream travel thereof as the blank B travels downstream between each of the pair of spaced-apart adhesive applicators 61, 66. Each of the pair of adhesive applicators 61, 66 include a plurality of adhesive application heads, 62*a*, 62*b*, 62*c*, 62*d*, 67*a*, 67*b*, 67*c*, 67*d*, e.g., four glue heads, and an adhesive supply hose 63, 68 respectively connected to the heads 62*a*, 62*b*, 62*c*, 62*d*, 67*a*, 67*b*, 67*c*, 67*d* so that enough adhesive is applied to the outer surface of the minor side panels fs2, rs2 by only one use of each adhesive applicator 61, 66. By focusing the adhesive on the minor side panels fs2, rs2, the apparatus 20 advantageously provides adhesive to a location which can use it for maximum benefits. For example, less adhesive is needed if it is applied in the appropriate locations, e.g., a plurality of glue lines 65, only on the minor side panels fs2, rs2 (see FIG. 4). Also, only two adhesive applicators 61, 66 are advantageously needed for applying adhesive to the blank B because the pair of spaced-apart applicators 61, 66 can apply adhesive to the two minor side panels fs2, rs2 on each side as the blank B travels downstream.

Front and rear panel lifting means 70 are positioned downstream from the pair of spaced apart rail guides 51, 52 for lifting each of the front and rear panels f1, r1 of the blank B upwardly and inwardly. The front and rear panel lifting means 70 preferably include blank conveying means 75, e.g., a blank conveyor, and a pair of spaced-apart lifting rails 71, 73 each pivotally mounted to the blank conveying means 70 for foldingly lifting each of the front and rear panels f1, r1 during conveyance downstream by abutting contact of portions of the respective lifting rails 71, 73 as illustrated in FIGS. 9, 10, 11A, 12A, and 13 and as understood by those skilled in the art. At least the rear panel lifting rail has portions thereof, for example, at least initially contacting and moving the major top panel inwardly when the lifting rails initially moves upwardly toward the blank and prior to contact with the top panel guiding means 80. The blank conveyor 75 preferably also includes a conveyor base which is generally flat for slideably conveying a blank B positioned thereon, a drive such as a motor, shafts mounted to the motor, and/or cam drives, for driving the blank in a linear and generally horizontal direction as illustrated.

Top panel guiding means 80 are positioned downstream from the front panel lifting means 70 for guiding each of the major top panels t1 of the blank B downwardly and inwardly so that the inner surface of each of the major top panels t1 overlies the inner surface of the bottom panel b1 of the blank B and for guiding each of the minor top panels t2 downwardly and inwardly so that the inner surface of the minor top panel t2 abuttingly contacts the outer surface of the minor side panel fs2, rs2 and the adhesive applied thereto. The top panel guiding means 80 preferably include at least first and second pairs of spaced-apart guide rails 81, 82, 83, 84. The first pair of spaced-apart guide rails 81, 82 is positioned for guiding the top major panel t1 downwardly and inwardly, and the second pair of spaced-apart guide rails 83, 84 is positioned for guiding the top minor panel t2 downwardly and inwardly. The first pair of spaced-apart guide rails 81, 82 is positioned at a higher elevation than the second pair of spacedapart guide rails 83, 84 when the blank B travels along the generally horizontal path of travel P.

Major side panel rail guides 91, 96 are positioned downstream from the front and rear panel lifting means 80 for guiding the major side panels s1 upwardly and inwardly so that the inner surface of each end periphery portion of each major side panel s1 abuttingly contacts the outer surface of each respective forward and rear minor side panel fs2, rs2.

Compressing means 100, e.g., a pair of compressors formed by belts positioned a spaced-apart pulleys, are positioned downstream from the major side panel rail guides 91, 96 for compressing the outer surfaces of the top minor panels t2 and the end periphery portions of the major side panels s1 so that the inner surfaces of the top minor panels t2 and the end periphery portions of the major side panels s1 press against the outer surface of the minor side panels fs2, rs2 of the blank B to thereby adhesively secure the blank B in an erect tray-forming position. Discharging means 110, e.g., a discharger, are positioned downstream from the compressing means 100 for discharging erect trays T therefrom (see, e.g., FIG. 13). The non-moving discharge platform receives the folded and glued blank and can be discharged, for example, when the next completed tray passes from the compressing means as understood by those skilled in the art.

Figure 14:
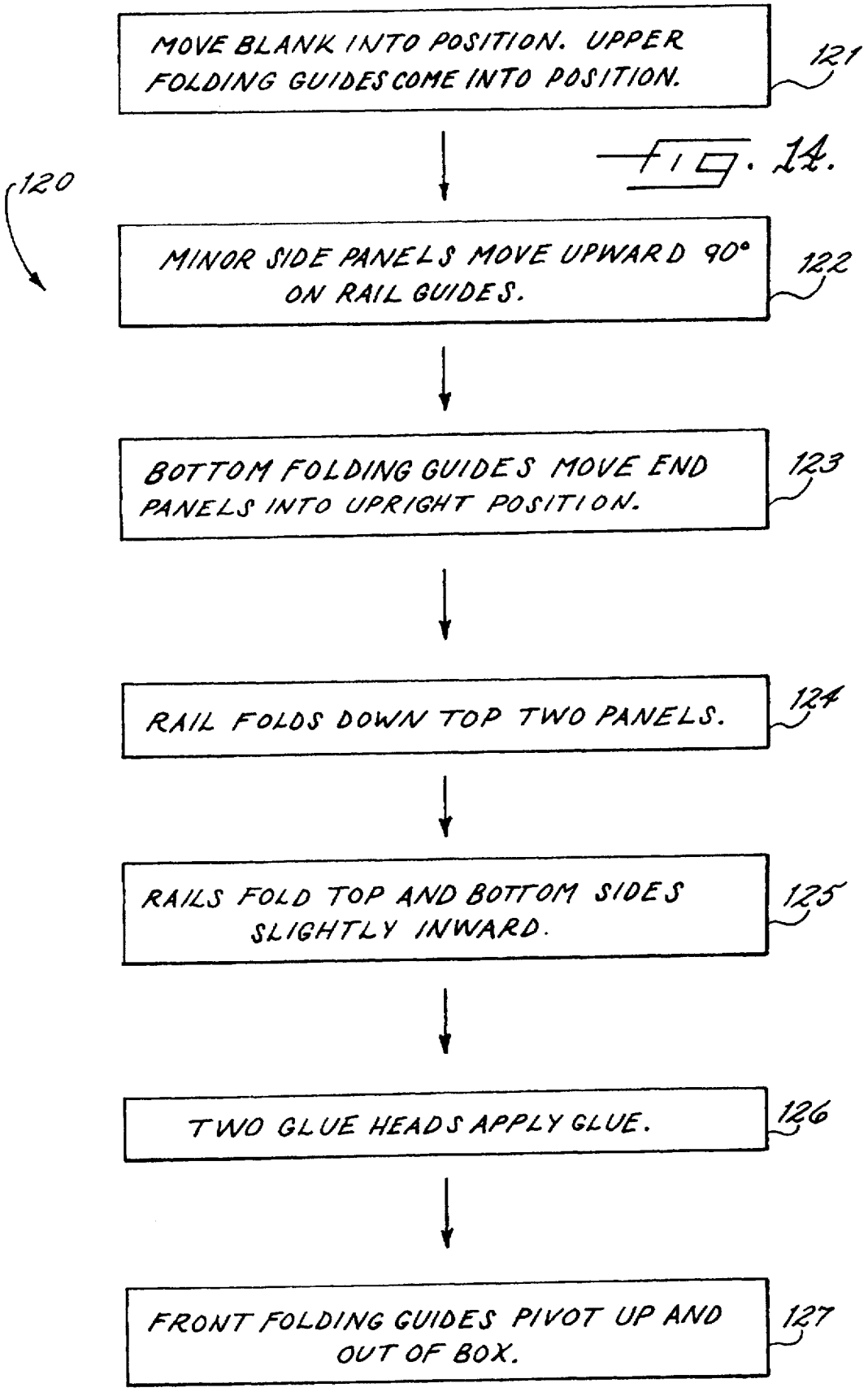
FIG. 14 is a schematic view of a method of forming a tray type container according to the present invention.

As illustrated in FIGS. 1–14, and particularly FIG. 14, methods 120 of forming a tray-type container T from a blank B having a plurality of cut and fold lines are also provided according to the present invention. A method preferably includes loading the blank B to be transported along a generally horizontal plane in a predetermined direction of travel P (block 121), respectively guiding each of the forward minor side panels fs2 of the blank B upwardly and inwardly (block 122), and respectively guiding each of the rearward minor side panels rs2 of the blank B upwardly and inwardly (block 125). Adhesive is applied only to the outer surface of each of the forward minor side panels fs2 and the rearward minor side panels rs2 during downstream travel thereof (block 126). Each of the front and rear panels f1, r1 of the blank B are foldingly lifted upwardly and inwardly (block 123). Each of the major top panels t1 of the blank B are foldingly guided downwardly and inwardly so that the inner surface of each of the major top panels t1 overlies the inner surface of the bottom panel b1 of the blank B (block 124).

Also, each of the minor top panels t2 are likewise foldingly guided downwardly and inwardly so that the inner surface of the minor top panel t2 abuttingly contacts the outer surface of the minor side panel fs2, rs2 and the adhesive applied thereto. The major side panels s1 are folded upwardly and inwardly so that the inner surface of each end periphery portion of each major side panel s1 abuttingly contacts the outer surface of each respective forward and rear minor side panel fs2, rs2. The outer surfaces of the top minor panels t2 and the end periphery portions of the major side panels s1 can then be compressed so that the inner surfaces of the top minor panels t2 and the end periphery portions of the major side panels s1 press against the outer surface of the minor side panels fs2, rs2 of the blank B to thereby adhesively secure the one blank B in an erect tray-forming position.

The method can further include conveying a plurality of front and rear guide arms 31, 32, 36, 37 overlying the blank B in a downstream path of travel simultaneous to the downstream travel of the blank B and abuttingly contacting each of the front and rear guide arms 31, 32, 36, 37 with the inner surface of each of the correspondingly positioned minor side panel fs2, rs2 of the blank B. The plurality of front and rear guide arms 31, 32, 36, 37 can be conveyed along a circular path of travel whereby at least a portion of the circular path corresponds to the path of travel P of the blank B. As the tray T is formed by the apparatus 20, the front and rear guide arms 31, 32, 36, 37 preferably are pivoted upwardly and out of the formed tray T just prior to being discharged from the apparatus (block 127). Additionally, the step of guiding the top panels t1, t2 as described above preferably includes guiding the top major panels t1 downwardly and inwardly and guiding the top minor panels t2 downwardly and inwardly so that the inner surfaces of the top minor panels t2 abuttingly contact the outer surfaces of the portions of the minor side panels fs2, rs2 having adhesive applied thereto.

Another method according to the present invention preferably includes lifting front and rear panels f1, r1 of a blank B upwardly and inwardly during travel along a predetermined path of travel P in a generally horizontal plane, applying adhesive only to selected portions fs2, rs2 of folded front and rear panels f1, r1 of the blank B when the blank B travels between at least a pair of space-apart adhesive applicators 61, 66, and folding side panels s1 of the blank B upwardly and inwardly into abutting contact with the selected portions fs2, rs2 of the folded front and rear panels f1, r1 having adhesive applied thereto.

The method can also include conveying a plurality of front and rear guide arms 31, 32, 36, 37 overlying the blank B in a downstream path of travel simultaneous to the downstream travel of the blank B, and abuttingly contacting each of the front and rear guide arms 31, 32, 36, 37 with the inner surface of each respective minor side panel fs2, rs2 of the blank B. The plurality of front and rear guide arms 31, 32, 36, 37 are conveyed along a circular path of travel whereby at least a portion of the circular path corresponds to the path of travel P of the blank B.

The method can further include guiding the top panels t1 downwardly and inwardly so as to overlie a bottom panel b1 of the blank B. The top major panels t1 are foldingly guided downwardly and inwardly, and the top minor panels t2 are also foldingly guided downwardly and inwardly so that the inner surfaces of the top minor panels t2 abuttingly contact the outer surfaces of the selected portions of the minor side panels fs2, rs2 having adhesive applied thereto. The outer surfaces of the top minor panels t2 and the end periphery portions of the major side panels s1 can then be compressed so that the inner surfaces of the top minor panels t2 and the end periphery portions of the major side panels s1 press against the outer surface of the minor side panels fs2, rs2 of the blank B to thereby adhesively secure the blank B in an erect tray-forming position.

A tray forming apparatus 20 and method according to the present invention thereby advantageously provides a streamlined and efficient process for producing tray-type containers T from pre-cut blanks B at a higher speed. The apparatus 20 advantageously uses fewer surfaces of a blank B for applying adhesive thereto and yet produces the same container T more efficiently and with similar structural bonding strength. The apparatus 20 advantageously can require less footprint in a production line and can be readily substitute various labeled blanks for producing labelled trays T for various customers.

Many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that the modifications and embodiments are intended to be included within the spirit and scope of the invention as described in the foregoing specification and as defined in the appended claims.

That which is claimed:

1. A tray forming apparatus for forming a tray from a blank having a plurality of cut and fold lines, the blank having a bottom panel, a pair of major side panels connected to the bottom panel along a common fold line, front and rear panels each connected to the bottom panel along respective common fold lines, a pair of front minor side panels each respectively connected along common fold lines to the front panel, a pair of rear minor side panels each respectively connected along common fold lines to the rear panel, a pair of top major panels each respectively connected to the front and rear panels along a common fold line, a pair of top minor panels connected to each of the top major panels along common fold lines, the apparatus comprising:

loading means for loading the blank to be transported along a generally horizontal plane in a predetermined direction of travel;

fold guiding means positioned to overlie the blank along the direction of travel for guiding the folding of the panels of the blank, said fold guiding means including at least a pair of front guide arms and a pair of rear guide arms;

a pair of spaced-apart rail guides positioned downstream from said loading means for respectively guiding each of the forward minor side panels of the blank upwardly and inwardly to a position closely adjacent one of the pair of front guide arms and for respectively guiding each of the rearward minor side panels of the blank upwardly and inwardly to a position closely adjacent one of the pair of rear guide arms when the blank travels downstream between said pair of spaced-apart rail guides;

a pair of spaced-apart adhesive applicators positioned downstream from said pair of spaced-apart rail guides for applying adhesive only to the outer surface of each of the forward minor side panels and the rearward minor side panels during downstream travel thereof as the blank travels downstream between each of said pair of spaced-apart adhesive applicators;

front and rear panel lifting means moving downstream with the travel of the blank for lifting each of the front and rear panels of the blank upwardly and inwardly;

top panel guiding means positioned adjacent said pair of spaced apart rail guides for guiding each of the major top panels of the blank downwardly and inwardly so that the inner surface of each of the major top panels overlies the inner surface of the bottom panel of the blank and for guiding each of the minor top panels downwardly and inwardly so that the inner surface of the minor top panel abuttingly contacts the outer surface of the minor side panel and the adhesive applied thereto;

major side panel rail guides positioned adjacent said pair of spaced apart rail guides for guiding the major side panels upwardly and inwardly so that the inner surface of each end periphery portion of each major side panel abuttingly contacts the outer surface of each respective forward and rear minor side panel;

compressing means positioned downstream from said major side panel rail guides for compressing the outer surfaces of the top minor panels and the end periphery portions of the major side panels so that the inner surfaces of the top minor panels and the end periphery portions of the major side panels press against the outer surface of the minor side panels of the one blank to thereby adhesively secure the one blank in an erect tray-forming position; and discharging means positioned downstream from said compressing means for discharging erect trays therefrom.

2. A tray forming apparatus as defined in claim 1, wherein said fold guiding means further includes a plurality of sets of pairs of front guide arms and pairs of rear guide arms and guide arm conveying means connected to each pair of front guide arms and each pair of rear guide arms for conveying each of the plurality of sets of pairs of front guide arms and pairs of rear guide arms downstream.

3. A tray forming apparatus as defined in claim 1, wherein each of said front and rear guide arms includes an arm member and a plate member connected to an end of said arm member, the outer surface of said plate member being adapted to abuttingly contact the inner surface of a minor side panel responsive to said compressing means.

4. A tray forming apparatus as defined in claim 2, wherein said guide arm conveying means comprises a drive, a first sprocket connected to the drive, a second sprocket positioned spaced-apart from said first sprocket, and a chain extending between and mounted to said first and second sprockets so that said drive drives said first sprocket and the chain and second sprocket mounted thereto and so that said plurality of sets of pairs of front and rear guide arms travel along a circular path of travel.

5. A tray forming apparatus as defined in claim 1, further comprising a frame, said front and rear panel lifting means and said fold guiding means each being connected to said frame.

6. A tray forming apparatus as defined in claim 1, wherein said front and rear panel lifting means include blank conveying means and a pair of spaced-apart lifting rails each pivotally mounted to said blank conveying means for lifting each of the front and rear panels during conveyance downstream.

7. A tray forming apparatus as defined in claim 1, wherein said top panel guiding means includes at least first and second pairs of spaced-apart guide rails, said first pair of spaced-apart guide rails for guiding the top major panel downwardly and inwardly and said second pair of spaced-apart guide rails for guiding the top minor panel downwardly and inwardly.

8. A tray forming apparatus as defined in claim 7, wherein said first pair of spaced-apart guide rails is positioned at a higher elevation than said second pair of spaced-apart guide rails when the blank travels along the generally horizontal plane of travel.

9. A tray forming apparatus as defined in claim 1, wherein each of said pair of adhesive applicators include a plurality of adhesive application heads so that enough adhesive is applied to the outer surface of the minor side panel by only one use of said each adhesive applicator.

10. A tray forming apparatus comprising:

loading means for loading one of a plurality of blanks to be transported along a predetermined path of travel in a generally horizontal plane;

front and rear panel lifting means positioned downstream from said loading means and positioned to abuttingly contact front and rear panels of the one of the plurality of blanks for foldingly lifting front and rear panels of the one blank upwardly and inwardly during travel along a predetermined path of travel in the generally horizontal plane;

adhesive applying means positioned adjacent said front and rear panel lifting means for applying adhesive only to selected portions of the folded front and rear panels of the one blank; and side panel folding means positioned adjacent said front and rear panel lifting means and said adhesive applying means for folding side panels of the one blank upwardly and inwardly into abutting contact with said selected portions of the folded front and rear panels having adhesive applied thereto.

11. A tray forming apparatus as defined in claim 10, further comprising fold guiding means for guiding the folding of the panels of the one blank, said fold guiding means including a plurality of sets of pairs of front guide arms and pairs of rear guide arms and guide arm conveying means connected to each pair of front guide arms and each pair of rear guide arms for conveying each of the plurality of sets of pairs of front guide arms and pairs of rear guide arms downstream.

12. A tray forming apparatus as defined in claim 11, wherein each of said front and rear guide arms includes an arm member and a plate member connected to an end of said arm member, the outer surface of said plate member being adapted to abuttingly contact the inner surface of a minor side panel of the one blank.

13. A tray forming apparatus as defined in claim 11, wherein said guide arm conveying means comprises a drive, a first sprocket connected to the drive, a second sprocket positioned spaced-apart from said first sprocket, and a chain extending between and mounted to said first and second sprockets so that said drive drives said first sprocket and the chain and second sprocket mounted thereto and so that said plurality of sets of pairs of front and rear guide arms travel along a circular path of travel.

14. A tray forming apparatus as defined in claim 13, further comprising a frame, said front and rear panel lifting means and said fold guiding means each being connected to said frame.

15. A tray forming apparatus as defined in claim 14, wherein said front and rear panel lifting means includes blank conveying means and a pair of spaced-apart lifting rails each pivotally mounted to said blank conveying means for foldingly lifting each of the front and rear panels during conveyance of the one blank downstream.

16. A tray forming apparatus as defined in claim 15, further comprising top panel guiding means positioned downstream from said front panel lifting means for guiding each of major top panels of the one blank downwardly and inwardly so that the inner surface of each of the major top panels overlies the inner surface of a bottom panel of the one blank and for guiding each of minor top panels downwardly and inwardly so that the inner surface of the minor top panel abuttingly contacts the outer surface of the minor side panel and the adhesive applied thereto, said top panel guiding means including at least first and second pairs of spaced-apart guide rails, said first pair of spaced-apart guide rails for guiding the top major panel downwardly and inwardly and said second pair of spaced-apart guide rails for guiding the top minor panel downwardly and inwardly.

17. A tray forming apparatus as defined in claim 16, wherein said first pair of spaced-apart guide rails of said top panel guiding means is positioned at a higher elevation than said second pair of spaced-apart guide rails of said top panel guiding means when the one blank travels along the generally horizontal path of travel.

18. A tray forming apparatus as defined in claim 17, wherein said adhesive applying means comprises a pair of spaced-apart adhesive applicators, each of said pair of spaced-apart adhesive applicators including a plurality of adhesive application heads so that enough adhesive is applied to the outer surface of the minor side panel by only one use of said each adhesive applicator.

19. A tray forming apparatus as defined in claim 18, compressing means positioned downstream from said side panel folding means for compressing side panels of the one blank to thereby secure the one blank in an erect tray-forming position, and discharging means positioned downstream from said compressing means for discharging erect trays therefrom.

20. A tray forming apparatus comprising:

front and rear panel lifters positioned to abuttingly contact and foldingly lift front and rear panels of a blank upwardly and inwardly during travel along a predetermined path of travel in a generally horizontal plane;

at least a pair of spaced-apart adhesive applicators positioned adjacent said front and rear panel lifters to apply adhesive only to selected portions of folded front and rear panels of a blank when a blank travels between said at least a pair of space-apart adhesive applicators; and at least a pair of spaced-apart side panel folders positioned adjacent said front and rear panel lifters and said at least a pair of space-apart adhesive applicators to fold side panels of a blank upwardly and inwardly into abutting contact with said selected portions of the folded front and rear panels having adhesive applied thereto.

21. A tray forming apparatus as defined in claim 20, further comprising a fold guide for guiding the folding of the panels of a blank, said fold guide including a plurality of sets of pairs of front guide arms and pairs of rear guide arms and a guide arm conveyor connected to each pair of front guide arms and each pair of rear guide arms for conveying each of the plurality of sets of pairs of front guide arms and pairs of rear guide arms downstream.

22. A tray forming apparatus as defined in claim 21, wherein each of said front and rear guide arms includes an arm member and a plate member connected to an end of said arm member, the outer surface of said plate member being adapted to abuttingly contact the inner surface of a minor side panel of a blank.

23. A tray forming apparatus as defined in claim 21, wherein said guide arm conveyor comprises a drive, a first sprocket connected to the drive, a second sprocket positioned spaced-apart from said first sprocket, and a chain extending between and mounted to said first and second sprockets so that said drive drives said first sprocket and the chain and second sprocket mounted thereto and so that said plurality of sets of pairs of front and rear guide arms travel along a circular path of travel.

24. A tray forming apparatus as defined in claim 23, further comprising a frame, said front and rear panel lifters and said fold guide each being connected to said frame.

25. A tray forming apparatus as defined in claim 24, wherein said front and rear panel lifters include a blank conveyor and a pair of spaced-apart lifting rails each pivotally mounted to said blank conveyor for lifting each of the front and rear panels during conveyance downstream.

26. A tray forming apparatus as defined in claim 25, further comprising a top panel guide positioned downstream from said front and rear panel lifters for guiding each of major top panels of a blank downwardly and inwardly so that the inner surface of each of the major top panels overlies the inner surface of a bottom panel of the blank and for guiding each of minor top panels downwardly and inwardly so that the inner surface of the minor top panel abuttingly contacts the outer surface of the minor side panel and the adhesive applied thereto, said top panel guide including at least first and second pairs of spaced-apart guide rails, said first pair of spaced-apart guide rails for guiding a top major panel downwardly and inwardly and said second pair of spaced-apart guide rails for guiding a top minor panel downwardly and inwardly.

27. A tray forming apparatus as defined in claim 26, wherein said first pair of spaced-apart guide rails of said top panel guide is positioned at a higher elevation than said second pair of spaced-apart guide rails of said top panel guide when a blank travels along a generally horizontal path of travel.

28. A tray forming apparatus as defined in claim 27, wherein each of said pair of spaced-apart adhesive applicators includes a plurality of adhesive application heads so that enough adhesive is applied to the outer surface of a minor side panel of a blank by only one use of said each adhesive applicator.

29. A method of forming a tray-type container from a blank having a plurality of cut and fold lines, the blank having a bottom panel, a pair of major side panels connected to the bottom panel along a common fold line, front and rear panels each connected to the bottom panel along respective common fold lines, a pair of front minor side panels each respectively connected along common fold lines to the front panel, a pair of rear minor side panels each respectively connected along common fold lines to the rear panel, a pair of top major panels each respectively connected to the front and rear panels along a common fold line, a pair of top minor panels connected to each of the top major panels along common fold lines, the method comprising:

loading the blank to be transported along a generally horizontal plane in a predetermined direction of travel;

respectively guiding each of the forward minor side panels of the blank upwardly and inwardly respectively guiding each of the rearward minor side panels of the one blank upwardly and inwardly;

applying adhesive only to the outer surface of each of the forward minor side panels and the rearward minor side panels during downstream travel thereof;

lifting each of the front and rear panels of the blank upwardly and inwardly;

guiding each of the major top panels of the blank downwardly and inwardly so that the inner surface of each of the major top panels overlies the inner surface of the bottom panel of the blank guiding each of the minor top panels downwardly and inwardly so that the inner surface of the minor top panel abuttingly contacts the outer surface of the minor side panel and the adhesive applied thereto;

guiding the major side panels upwardly and inwardly so that the inner surface of each end periphery portion of each major side panel abuttingly contacts the outer surface of each respective forward and rear minor side panel; and compressing the outer surfaces of the top minor panels and the end periphery portions of the major side panels so that the inner surfaces of the top minor panels and the end periphery portions of the major side panels press against the outer surface of the minor side panels of the blank to thereby adhesively secure the one blank in an erect position.

30. A method of forming a tray-type container as defined in claim 29, further comprising conveying a plurality of front and rear guide arms overlying the blank in a downstream path of travel simultaneous to the downstream travel of the blank.

31. A method of forming a tray-type container as defined in claim 30, further comprising abuttingly contacting at least one front or rear guide arm with the inner surface of a minor side panel of the blank.

32. A method of forming a tray-type container as defined in claim 30, further comprising conveying the plurality of front and rear guide arms along a circular path of travel whereby at least a portion of the circular path corresponds to the path of travel of the blank.

33. A method of forming a tray-type container as defined in claim 29, wherein the step of guiding the top panels comprises guiding the top major panels downwardly and inwardly and guiding the top minor panels downwardly and inwardly so that the inner surfaces of the top minor panels abuttingly contact the outer surfaces of the portions of the major side panels having adhesive applied thereto.

34. A method of forming a tray-type container, the method comprising:

contactingly lifting each of front and rear panels of a blank upwardly and inwardly during travel along a predetermined path of travel in a generally horizontal plane;

applying adhesive only to selected portions of folded front and rear panels of the blank when the blank travels between at least a pair of space-apart adhesive applicators; and folding side panels of the blank upwardly and inwardly into abutting contact with the selected portions of the folded front and rear panels having adhesive applied thereto.

35. A method of forming a tray-type container as defined in claim 34, further comprising conveying a plurality of front and rear guide arms overlying the blank in a downstream path of travel simultaneous to the downstream travel of the blank.

36. A method of forming a tray-type container as defined in claim 35, further comprising abuttingly contacting at least one front or rear guide arm with the inner surface of a minor side panel of the blank.

37. A method of forming a tray-type container as defined in claim 36, further comprising conveying the plurality of front and rear guide arms along a circular path of travel whereby at least a portion of the circular path corresponds to the path of travel of the blank.

38. A method of forming a tray-type container as defined in claim 37, further comprising guiding the top panels downwardly and inwardly so as to overlie a bottom panel of the blank.

39. A method of forming a tray-type container as defined in claim 38, further comprising guiding the top major panels downwardly and inwardly and guiding the top minor panels downwardly and inwardly so that the inner surfaces of the top minor panels abuttingly contact the outer surfaces of the portions of the major side panels having adhesive applied thereto.

40. A method of forming a tray-type container as defined in claim 39, further comprising compressing the outer surfaces of the top minor panels and the end periphery portions of the major side panels so that the inner surfaces of the top minor panels and the end periphery portions of the major side panels press against the outer surface of the minor side panels of the blank to thereby adhesively secure the one blank in an erect position.

* * * * *